US005843605A

United States Patent [19]

Anno et al.

[11] Patent Number: 5,843,605

[45] Date of Patent: Dec. 1, 1998

[54] YELLOW DEVELOPER

[75] Inventors: Masahiro Anno, Sakai; Katsunori Kurose, Amagasaki; Hiroyuki Fukuda, Kobe, all of Japan

[73] Assignee: Minolta Co., Ltd., Osaka, Japan

[21] Appl. No.: 47,371

[22] Filed: Mar. 25, 1998

[30] Foreign Application Priority Data

Mar. 28, 1997 [JP] Japan ..... 9-077557

[51] Int. Cl.[6] ..... G03G 13/06; G03G 9/09

[52] U.S. Cl. ..... 430/45; 430/106; 430/110; 430/111; 430/903

[58] Field of Search ..... 430/45, 106, 110, 430/111, 903

[56] References Cited

U.S. PATENT DOCUMENTS

| | | | |
|---|---|---|---|
| 5,176,978 | 1/1993 | Kumashiro et al. | 430/110 |
| 5,424,162 | 6/1995 | Kohri et al. | 430/110 |
| 5,439,772 | 8/1995 | Takagi et al. | 430/106.6 |
| 5,486,445 | 1/1996 | Van Dusen et al. | 430/110 |
| 5,578,407 | 11/1996 | Kasuya et al. | 430/111 |
| 5,637,427 | 6/1997 | Yamamoto et al. | 430/45 |
| 5,660,964 | 8/1997 | Machida et al. | 430/110 |
| 5,665,512 | 9/1997 | Tsutsui et al. | 430/110 |
| 5,702,860 | 12/1997 | Koyama et al. | 430/137 |
| 5,712,068 | 1/1998 | Dalal et al. | 430/106 |
| 5,721,083 | 2/1998 | Masada et al. | 430/106 |
| 5,736,291 | 4/1998 | Dalal et al. | 430/106 |
| 5,747,213 | 5/1998 | Okado et al. | 430/110 |

*Primary Examiner*—Roland Martin
*Attorney, Agent, or Firm*—McDermott, Will & Emery

[57] ABSTRACT

The present invention relates to A yellow developer comprising:

a non-magnetic toner particle containing colorant, binder resin and wax, the colorant being a compound classified into C. I. pigment yellow 180, the binder resin having an acid value of 1 to 30 KOH mg/g, and the wax having an acid value of 0.5 to 30 KOH mg/g.

20 Claims, 2 Drawing Sheets

YELLOW DEVELOPER

This application is based on application No. Hei 9-077557 filed in Japan, the content of which is hereby incorporated by reference.

BACKGROUND OF THE INVENTION

1. Field of the Invention

The present invention relates to a yellow developer for development of electrostatic latent images. More specifically, the invention relates to a yellow developer for development of electrostatic latent images to be used particularly in full-color image forming apparatuses such as full-color electrostatic copiers and full-color laser beam printers.

2. Description of the Prior Art

In the process of fixing a toner image supported on transfer paper by a contact-heating fixing method such as the thermal roll fixing method or the belt fixing method, there has conventionally been an issue of the phenomenon (offset phenomenon) that molten toner transfers to members, such as a fixing upper roller or fixing belt, with which the toner image makes contact, and the transferred toner re-adheres to the succeeding transfer paper with the result of occurrence of image noise.

As a technique for preventing the offset phenomenon, it is known to add wax such as low molecular weight polypropylene into the toner. However, diversion of this technique to toners for use in full-color image forming apparatuses would cause the following problems.

For example, when a full color image is formed by a full-color laser printer, small dot diameter is required for reproduction of high-definition images, while the density of the color of a color image is reproduced by variations in the dot area ratio per unit area. In this case, forming a light-colored image having a low dot area ratio (an image with dots dispersed) would pose a problem that light transmittance and color reproducibility tend to lower due to irregular reflection caused by the dispersed dots, as compared with a deep-colored image having a high dot area ratio (an image with dots continuously present), the problem growing considerable with decreasing dot diameter. Adding a wax to the toner would make this problem more considerable, such that color reproducibility of light colors would degrade particularly in the image formation on overhead projector films (hereinafter, referred to as "OHP films") as another problem. This problem is more considerable particularly in yellow toner having a high frequency of color reproduction of light colors. Also, the addition of wax would cause further problems such as filming on the photosensitive member.

As colorants to be used for the yellow toner, there are available known organic pigments and dyes, which however have various disadvantages, respectively. For example, a dye, which is present generally as it is melted in the binder resin of the toner, is superior in light-transmittance and chroma but have disadvantages of being low in heat resistance and light resistance. Because of the low light resistance that causes light-induced discoloring, there arises an problem that an image of good chroma, even if obtained, could not be maintained for a long time. The low heat resistance causes another problem that a dye, when subjected to thermal fixation, is likely to sublimate in the vicinity of the fixing part, causing apparatus interior contamination. Also, some dyes dissolve in mold releasing agents such as silicone oil applied to the feed roller, such that the image may be dirtied as a further problem. From these and other points of view, it is preferable to use pigments. However, because of high flocculating property, a pigment is difficult to finely disperse in the toner, such that the hiding power of the toner would become strong, with the light-transmittance lowered. Further, occurrence of flocculation of the pigment particles would make it impossible to obtain a spectral reflection characteristic for correctly reproducing the document because of the light scattering due to the particles, while the strength of the hiding power makes a cause of poor light transmittance. As a result, pigments, when used for OHP sheets would result in a dark projected image and a low chroma, disadvantageously. Further, some pigments are so low in heat resistance that they are decomposed during the preparation of toner or during the heat fixing process.

In recent years, the full-color image forming apparatus has been under discussion for downsizing, for which the developing unit needs to be downsized. This is because the full-color image forming apparatus requires four developing units containing cyan developer, yellow developer, magenta, developer and black developer, respectively. For downsizing of the developing units, it is advantageous to employ a non-magnetic one-component developing unit that requires no mechanism for stirring toner and carrier. However, the non-magnetic one-component developing unit has a problem that the developer supporting member and the developer regulating member are prone to occurrence of toner adhesion. This problem is particularly pronounced in full-color toners that require light transmittance and that use a binder resin exhibiting a sharp melt characteristic.

SUMMARY OF THE INVENTION

The present invention is to provide a yellow developer for formation of full-color images, which has solved the above-described problems.

Accordingly, an object of the present invention is to provide a yellow developer which is excellent in offset-withstanding and light-transmitting properties and which has solved the problem of filming onto the photosensitive member.

Another object of the present invention is to provide a yellow developer which exhibits an excellent yellow-color reproducibility even in the reproduction of images having low dot area ratios.

Still another object of the present invention is to provide a yellow developer which has solved the problem of toner adhesion to the developer supporting member and the developer regulating member in applications to the non-magnetic one-component development system.

The objects may be achieved by a yellow developer for use in full-color image forming apparatuses capable of reproducing multicolor images, the yellow developer containing a non-magnetic toner particle which comprises a binder resin having an acid value of 1.0 to 30 KOH mg/g, a compound classified into C. I. pigment yellow 180 and a wax having an acid value of 0.5 to 30 KOH mg/g.

DETAILED DESCRIPTION OF THE INVENTION

Figure 1:
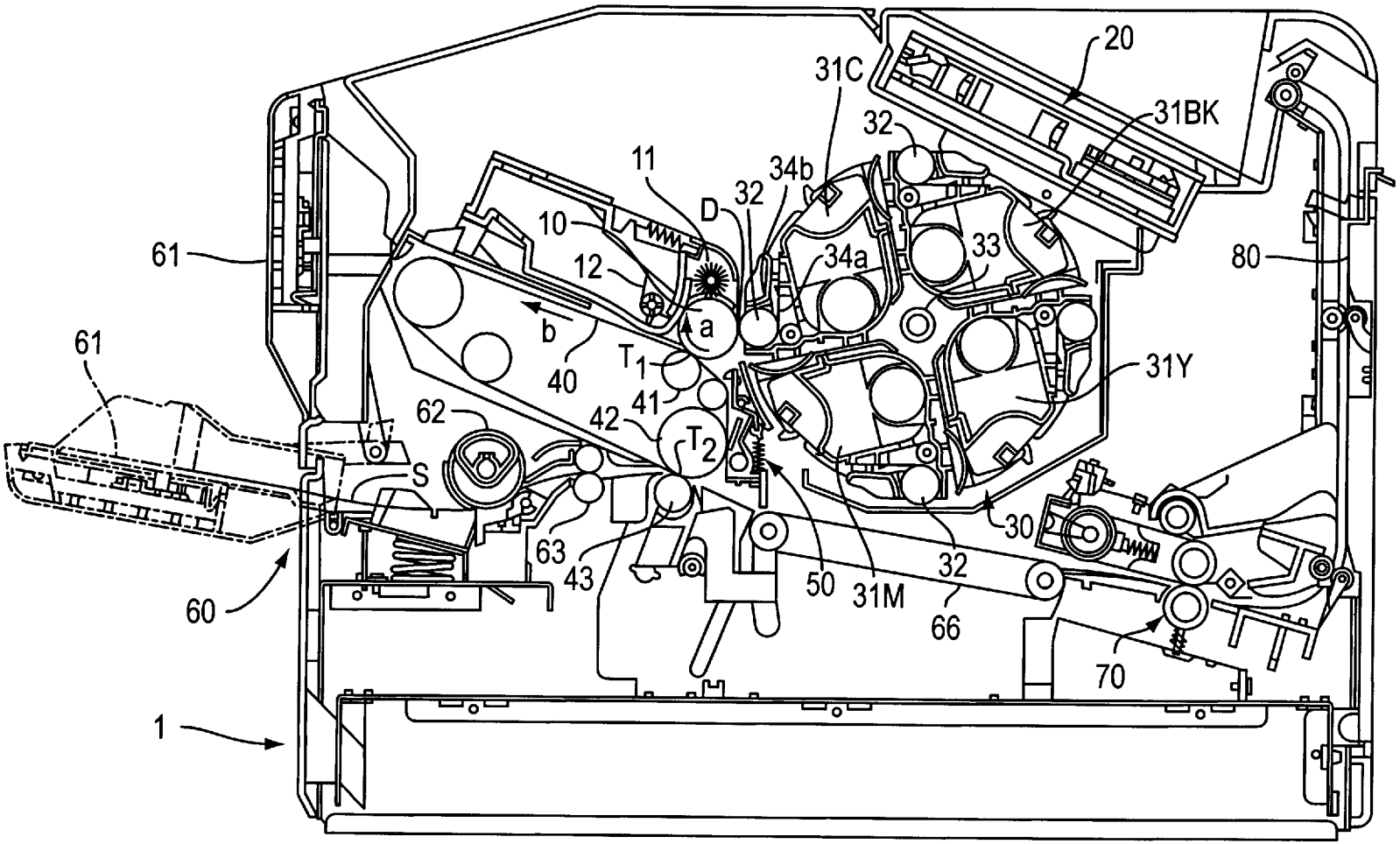
FIG. 1 is a schematic explanatory view of a full-color printer.

The present invention relates to a yellow developer for use in full-color image forming apparatuses capable of reproducing multicolor images, the yellow developer containing a non-magnetic toner particle which comprises a binder resin having an acid value of 1.0 to 30 KOH mg/g, a compound classified into C. I. pigment yellow 180 and a wax having an acid value of 0.5 to 30 KOH mg/g.

The full-color yellow toner of the present invention contains, as a yellow colorant, a compound classified into C. I. pigment yellow 180. A yellow toner containing the C. I. pigment yellow 180 exhibits excellent characteristics in light-transmitting and color-reproducing properties. Also, the C. I. pigment yellow 180, by virtue of its excellence in both light resistance and heat resistance, is free from the possibility of decomposing and causing any harmful substances even when heated during the preparation or fixation of toner, thus showing a high safety.

When the toner containing the C. I. pigment yellow 180 is used as a non-magnetic one-component developer, toner adhesion would occur to the developer supporting member or developer regulating member of the developing unit, resulting in image noise. Also, when a wax normally used as an offset inhibitor, such as low molecular weight polypropylene, is contained in the toner containing the C. I. pigment yellow 180 with a view to improving the offset property of the toner, there are some cases in which filming onto the photosensitive member occurs with the result of image noise or the excellent light-transmitting and color-reproducing properties are impaired.

Therefore, a wax having an acid value of 0.5 to 30 KoH mg/g, preferably 1 to 20 KOH mg/g, more preferably 2 to 20 KOH mg/g is used in the present invention. A wax having such an acid value has an enhanced compatibility with a binder resin having a later-described acid value, so that the wax is enhanced in dispersibility in the binder resin while the wax becomes unlikely to separate off during the preparation of toner. This makes it possible to solve the issue of filming. Also, such a wax, also when contained in the toner used as a non-magnetic one-component developer, makes it possible to solve the issue of toner adhesion to the developer supporting member and the developer regulating member.

This wax is not particularly limited and may be any one having an acid value as described above, including oxidized polypropylene wax, oxidized polyethylene wax, carnauba wax, rice wax, Fischer-Tropsch wax, montan ester wax, partially saponified ester wax and the like. The oxidized polypropylene wax is preferably a low molecular weight polypropylene modified by an acid monomer such as acrylic acid, methacrylic acid, maleic acid and maleic anhydride. Oxidized polypropylene waxes having an acid value of 0.5 to 30 KOH mg/g, preferably 1 to 20 KOH mg/g, are usable, their commercially available examples including Viscol TS200 (with softening point 140° C., acid value 3.5 KOH mg/g), Viscol 100TS (with softening point 140° C., acid value 3.5 KOH mg/g) and Viscol 110TS (with softening point 140° C., acid value 3.5 KOH mg/g) made by Sanyo Kasei Kogyo K.K.

Oxidized polyethylene waxes having an acid value of 0.5 to 30 KOH mg/g, preferably 1 to 20 KOH mg/g, are usable, their commercially available examples including E300 (with softening point 103.5° C., acid value 22 KOH mg/g), E250P (with softening point 103.5° C., acid value 19.5 KOH mg/g) and E310 (with softening point 104° C., acid value 15 KOH mg/g) made by Sanyo Kasei Kogyo K.K., 4053E (with softening point 145° C., acid value 25 KOH mg/g), 405MP (with softening point 128° C., acid value 1 KOH mg/g), 310MP (with softening point 122° C., acid value 1 KOH mg/g), 320MP (with softening point 114° C., acid value 1 KOH mg/g), 210MP (with softening point 118° C., acid value 1 KOH mg/g), 220MP (with softening point 113° C., acid value 1 KOH mg/g), 4051E (with softening point 120° C., acid value 12 KOH mg/g), 4052E (with softening point 115° C., acid value 20 KOH mg/g), 4202E (with softening point 107° C., acid value 17 KOH mg/g) and 2203A (with softening point 111° C., acid value 30 KOH mg/g) made by Mitsui Sekiyu Kagaku Kogyo K.K.

Carnauba waxes, preferably microcrystalline ones, having an acid value of 0.5 to 10 KOH mg/g, preferably 1 to 6 KOH mg/g, are usable.

Montan ester waxes, preferably microcrystalline ones like the carnauba wax, having an acid value of 1 to 20 KOH mg/g, preferably 3 to 15 KoHmg/g, are usable.

Rice waxes, preferably those obtained by air-oxidizing rice bran, having an acid value of 5 to 30 KOH mg/g are usable.

Fischer-Tropsch waxes can be obtained as a by-product in producing synthetic oil from charcoal by hydrocarbon synthesis process, one commercially available example being Sazol wax made by Sazol K.K. In addition to this, a Fischer-Tropsch wax that can be obtained with natural gas used as a starting material is also usable, in which case the wax contains less low molecular weight components, thus being superior in heat resistance when used for toner. Fischer-Tropsch waxes having an acid value of 0.5 to 30 KOH mg/g are usable, and those having an acid value of 3 to 30 KOH mg/g are preferable among Sazol waxes, which are exemplified by Sazol wax A1, Sazol wax A2, etc. made by Sazol K.K.

Also for the present invention, waxes having a softening point of 110° to 160° C., preferably 130° to 160° C., are preferable. Waxes having a softening point lower than 110° C. are likely to result in an insufficient effect for enhancement in high-temperature offset property, while waxes having a softening point higher than 160° C. are likely to result in an insufficient dispersion in the binder resin, causing a higher possibility of filming onto the photosensitive member.

In the present invention, the content of wax is 0.5 to 5 parts by weight, preferably 1 to 3 parts by weight, on the basis of 100 parts by weight of binder resin. Contents of wax less than 0.5 part by weight would result in an insufficient effect for improvement in the offset-withstanding property or for resolving the toner adhesion to the developer supporting member or the developer regulating member, while those more than 5 parts by weight would result in a decrease in the light-transmitting or color-reproducing property.

In the present invention also, preferably, the wax particles contained in the toner have a particle size distribution that wax particles with particle size equal to or more than 3 $\mu$m occupy 3 number % or less, wax particles with particle size equal to or more than 2 $\mu$m and less than 3 $\mu$m occupy 12 number % or less, wax particles with particle size equal to or more than 1 $\mu$m and less than 2 $\mu$m occupy 5 to 30 number %, and wax particles with particle size less than 1 $\mu$m occupy 55 to 95 number %. By the wax particles being dispersedly contained in the toner with such a particle size distribution, the toner can be improved both in the offset-withstanding property and in OHP light transmitting and color reproducing properties for images having smaller dot sizes and low dot area ratios. The reason of this is that larger particle size wax particles tend to hinder the light transmittance and color reproducibility particularly in images having low area ratios, while micro-dispersion of all the wax particles would deteriorate the offset-withstanding property effect.

In the present invention, a preferable particle size distribution of wax particles of the toner is that wax particles with particle size equal to or more than 5 μm occupy substantially 0 number % and wax particles with particle size equal to or more than 3 μm and less than 5 μm occupy 3 number % or less, more preferably that wax particles with particle size equal to or more than 4 μm occupy substantially 0 number % and wax particles with particle size equal to or more than 3 μm and less than 4 μm occupy 3 number % or less, more preferably 2 number % or less. Also, the particle size distribution is that wax particles with particle size equal to or more than 2 μm and less than 3 μm occupy 10 number % or less, more preferably 8 number % or less, and wax particles with particle size equal to or more than 1 μm and less than 2 μm occupy 5 to 27 number %, more preferably 7 to 27 number %, and wax particles with particle size less than 1 μm occupy 60 to 95 number %, more preferably 60 to 90 number %.

The particle size distribution of wax particles contained in the toner was measured with an photographic image obtained through the steps of dissolving the toner into an organic solution that dissolves the binder resin such as chloroform, centrifuging the solution, gathering increasingly suspended wax particles and taking an electron micrograph of them. For example, the process may be implemented by inputting a photographic image of wax particles into an image analyzer (Luzex 5000 made by Nippon Regulator K.K.) with a scanning electron microscope photograph and calculating the particle size distribution. In addition, for the present invention, if wax particles are not completely circular, the particle size of the wax particles is determined by measuring the maximum diameter of the wax particles.

Another method for measuring the particle size of wax particles is to take a transmission electron microscope (TEM) photograph of a microtome section of toner particles and perform the measurement. However, because the particle size of wax particles measured by this method would be detected as much smaller values different from the particle size of the wax particles actually contained in the toner, this method is unfavorable. With this method, since the wax particle size of a cut section of toner particles is measured, the measured wax particle size would quite differ even with spherical wax particles of the same particle size, for example, between a case where the center of a wax particle is present in the cut section and another case where a decentered end portion of a wax particle is present in the cut section. In still another case of wax particles of rugby-ball like shape or the like, deviations of the measured particle size would be more pronounced due to differences in the cut direction or cut portion.

In the present invention, for improvement in the dispersibility of the C. I. pigment yellow 180 and waxes having the above acid values in the binder resin, a binder resin having an acid value of 1.0 to 30.0 KOH mg/g, preferably 1.0 to 25.0 KOH mg/g, more preferably 2.0 to 20.0 KOH mg/g, is used. This is because acid values smaller than 1.0 KOH mg/g would lessen the dispersibility improving effect, acid values larger than 30.0 KOH mg/g would strengthen the negative chargeability and cause greater changes in charge amount due to environmental variations.

Binder resins having such an acid value may be used without limitations in type of resin, their examples including styrene-acrylic copolymer resins, polyester resins, epoxy resins or the like. These may be used singly or in mixing. Among these, particularly preferable are polyester resins.

In the present invention, preferable polyester resins are those synthesized by using, as alcohol components, bisphenol A alkylene oxide adduct which is the primary component, and using, as acid components, phthalic acid or derivative thereof, or phthalic acid or derivative thereof and aliphatic dicarboxylic acid, through condensation polymerization reaction.

The bisphenol A alkylene oxide adduct is preferably a bisphenol A propylene oxide adduct or a bisphenol A ethylene oxide adduct, where it is preferable to use these adducts in mixing.

As the alcohol components, the following diols or polyhydric alcohols may be used in slight amount together with the bisphenol A alkylene oxide adduct. Such alcohol components include diols such as ethylene glycol, diethylene glycol, triethylene glycol, 1,2-propylene glycol, 1,3-propylene glycol, 1,4-butane diol and noepentyl glycol, sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzen.

As the phthalic acid or derivative thereof, are usable phthalic acid or derivative thereof, such as terephthalic acid and isophthalic acid, their acid anhydrides or their lower alkyl esters and the like.

Aliphatic dicarboxylic acids that can be used together with the phthalic acid or derivative thereof are exemplified by aliphatic dicarboxylic acids such as fumaric acid, maleic acid, succinic acid, alkyl or alkenyl succinic acids with carbon number 4 to 18, their acid anhydrides or their lower alkyl esters and the like.

Further, for adjustment of the acid value of the resin, polycarboxylic acids such as trimellitic acid may be used in small amounts within such a range as will not impair the light-transmittance of the toner. Such a polycarboxylic acid component is exemplified by 1,2,4-benzene tricarboxylic acid (trimellitic acid), 1,2,5-benzene tricarboxylic acid, 2,5,7-naphthalene carboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxylic propane, 1,2,4-cyclohexane tricarboxylic acid, tetra(methylenecarboxyl)methane, 1,2,7,8-octane tetracarboxylic acid, pyromellitic acid, and their anhydrides and lower alkyl esters, and the like.

The binder resin used for the present invention is one having a glass transition point of 55° to 75° C., preferably 60° to 70° C., a softening point of 95° to 120° C., preferably 100° to 118° C., a number-average molecular weight of 2500 to 6000, preferably 3000 to 5500, and a ratio of weight-average molecular weight/number-average molecular weight of 2 to 8, preferably 3 to 7. Lower glass transition points would cause the toner to lower in heat resistance, while higher ones would cause the toner to lower in light-transmitting and color-mixing properties. Lower softening points would make high-temperature offset more likely to occur in the fixing process, while higher softening points would make the fixing strength lower. Smaller number-average molecular weights would make the toner more likely to be peeled when the image is bent, while larger number-average molecular weights would make the fixing strength lower. Besides, smaller weight-average molecular weights would make high-temperature offset more likely to occur, while larger ones would make the toner to lower in light transmittance.

In the yellow developer of the present invention, the C. I. pigment yellow 180 may be subjected to masterbatch process or flushing process so that its dispersibility into the binder resin is enhanced. The content of the C. I. pigment yellow 180 is preferably 2 to 15 parts by weight on the basis of 100 parts by weight of binder resin.

Other than the above, desired additives such as charging control agents may be added to the toner of the present invention.

Known charging control agents may be used and permissible ones are achromatic, white or hypochromic charging control agents that do not adversely affect the color tone or light transmittance of the yellow toner. It is preferable to use charging control agents such as zinc complex of salicylic acid derivatives or other metal complexes of salicylic acid, calix arene compounds, organic boron compounds, fluorine-containing quaternary ammonium salt compounds and the like. The metal complexes of salicylic acid may be, for example, those described in U.S. Pat. Nos. 4,206,064 and 4,762,763 or the like; the calix arene may be, for example, those described in U.S. Pat. No. 5,049,467; the organic boron compounds may be, for example, those described in Japanese Patent Laid-Open Publication HEI 2-221967; and the fluorine-containing quaternary ammonium salt compounds may be, for example, those described in U.S. Pat. No. 5,069,994 or the like.

These charging control agents, when added, are preferably used in an amount of 0.1 to 10 parts by weight, preferably 0.5 to 5.0 parts by weight on the basis of 100 parts by weight of binder resin.

Besides, in the present invention, it is preferable to externally add 0.2 to 3% by weight of inorganic fine particles to the toner. As these inorganic fine particles, silica, titania, alumina, strontium titanate, stannic oxide and the like may be used singly or in mixed two or more kinds. In addition to such inorganic compounds, 1 $\mu$m or smaller resin fine particles may also be externally added.

The toner according to the present invention is preferably adjusted to a volume-average particle size of 4 to 10 $\mu$m, preferably 5 to 9 $\mu$m, in terms of high-definition reproducibility of images.

For the present invention, the yellow developer can be fabricated by known process. A preparation example by kneading and grinding process is given below.

First, binder resin, colorant and wax, plus additives such as charging control agent and dispersant, and toner fine powder generated in the preparation process, are mixed together with a mixer such as Henschel mixer, by which a mixture of the toner components is prepared. The colorant used in this case is preferably a masterbatch colorant.

Next, the prepared mixture is melted and kneaded by using an extrusion kneader. Then, the kneaded product is discharged from the extrusion kneader, where it is preferably discharged in such a way that the pressure applied to the kneaded product will not be larger than the pressure due to conveyance, from the viewpoint of adjusting the dispersed particle size of wax to a minute one. This can be achieved by removing the nozzle and head portions in the discharge section of the extrusion kneader. The reason of this is that the cross-sectional area of the discharge section of the extrusion kneader is generally smaller than the cross-sectional area of the kneading section or conveying section.

Also, for the cooling of the kneaded product discharged from the extrusion kneader, it is preferable to avoid the pressing by a cooling press roller or, with the use a press roller, to set a large roller spacing for delivery to the succeeding grinding step. This is because narrow press roller spacings would cause the wax particles to be crushed by the pressure due to the pressing of the kneaded product, resulting in larger particle sizes, where the roller spacing is preferably set to 1 mm or more. The cooled kneaded product is coarsely ground, finely ground and classified in fine powder, by which toner particles are obtained.

The toner of the present invention can be applied to a two-component developer toner to be mixed with carrier in use, or to a one-component developing toner with no carrier used. In particular, from the standpoint of downsizing the full-color image forming apparatus, it is preferable to apply the toner to the non-magnetic one-component developing system in which a restrictive blade that is a developer regulating member is pressed into contact with a developing sleeve that is a developer supporting member, and in which the toner is charged when passed through the restrictive part.

When the toner of the present invention is used as a two-component developer, preferable carriers are exemplified by a resin-coated carrier made by coating magnetic substance particles such as iron, magnetite or ferrite with resin, or a binder carrier made by dispersing magnetic fine particles in binder resin. From the points of view of toner spent and the like, it is preferable to use a resin-coated carrier obtained by using silicone resin, copolymer resin (graft resin) of organopolysiloxane and vinyl monomer or polyester resin as the coating resin, or use a binder carrier obtained by using styrene-acrylic resin, polyester resin or their mixtures as the binder resin.

A preferable two-component development system is a development process in which a thin developer layer, more specifically a developer layer having a developer amount of 0.7 to 10 mg/cm$^2$, preferably 1 to 7.5 mg/cm$^2$, is supported on a developer transporting member (developing sleeve) having a magnet roller fixedly disposed inside, and the developer layer is fed to a development area, where development is carried out under the condition that an oscillatory electric field, preferably a developing bias obtained by superimposition of a DC voltage and an AC voltage, is applied to the development area. In this case, it is preferable to use a magnetic carrier having a volume-average particle size of 20 to 50 $\mu$m, preferably 25 to 40 $\mu$m, with a view to ensuring high image quality and preventing carrier adhesion.

EXAMPLES

Hereinbelow, the present invention will be described concretely by way of examples thereof, but the invention is not limited to these examples.

(Preparation Examples of Polyester Resins A–E)

In a 4-necked glass flask equipped with a thermometer, a stirrer, a flow-down capacitor and a nitrogen inlet tube, was placed alcohol component and acid component together with polymerization initiator (dibutyltin oxide) in molar ratios as shown in Table 1. This was stirred and heated in a mantle heater under a nitrogen atmosphere so as to react. Thus, polyester resins A–E having number-average molecular weights (Mn), ratios of weight-average molecular weight/number-average molecular weight (Mw/Mn), glass transition points (Tg), softening points (Tm), acid values and hydroxyl values as shown in Table 1 were obtained. In Table 1, PO denotes polyoxypropylene (2,2)-2,2-bis(4-hydroxyphenyl)propane, EO denotes polyoxyethylene(2,0)-2,2-bis(4-hydroxyphenyl) propane, GL denotes glycerin, TPA denotes terephthalic acid, TMA denotes trimellitic acid and FA denotes fumaric acid.

TABLE 1

| Resin | Alcohol component PO | EO | GL | Acid component TPA | TMA | FA | Mn | Mw/Mn | Tg (°C.) | Tm (°C.) | Acid value (KOHmg/g) | Hydroxyl value (KOHmg/g) |
|---|---|---|---|---|---|---|---|---|---|---|---|---|
| A | 4.0 | 6.0 | — | 9.0 | — | — | 3300 | 4.2 | 68.5 | 110.3 | 3.3 | 28.1 |
| B | 3.5 | 6.0 | 0.5 | 9.0 | — | — | 3400 | 4.5 | 64.8 | 115.2 | 4.9 | 23.0 |
| C | 5.0 | 5.0 | — | 4.0 | — | 5.0 | 3800 | 3.0 | 68.3 | 102.8 | 3.8 | 28.7 |
| D | 3.0 | 7.0 | — | 7.0 | 2.0 | — | 2800 | 2.3 | 59.5 | 101.8 | 1.3 | 60.4 |
| E | 2.5 | 7.5 | — | 5.0 | — | 7.5 | 5200 | 4.3 | 61.0 | 99.5 | 24.9 | 19.1 |

It is noted that the molecular weight was determined with gel permeation chromatography (807-IT, made by Nihon Bunko Kogyo K.K.), by using tetrahydrofuran as a carrier solvent, and by polystyrene conversion.

The glass transition point was measured on a 10 mg sample weighed by using a differential scanning calorimeter (DSC-200, made by Seiko Denshi K.K.). In this measurement, with alumina used as a reference, the shoulder value of a main endothermic peak in a range of 30° to 80° C. was taken as the glass transition point.

The softening point was measured on a 1.0 g sample with a flow tester (CFT-500, made by Shimadzu Seisakusho K.K.) and by using a 1.0 mm×1.0 mm die under the conditions of a temperature increasing rate of 3.0° C./min. and a load of 30 kg. Thus, the temperature resulting when the sample has flowed out by ½ was taken as the softening point.

The acid value was determined by dissolving the weighed sample into a pertinent solvent and expressing the measured value in mg number of potassium hydroxide needed to neutralize acidic groups by using an indicator like phenolphthalein.

The hydroxyl value was determined by hydrolyzing an acetylated compounds obtained by treating the weighed sample with acetic anhydride and expressing the measured value in mg number of potassium hydroxide needed to neutralize free acetic acid.

(Example 1)

Polyester resin A and yellow pigment (C. I. pigment yellow 180) were charged and kneaded to a pressure kneader so that the weight ratio of resin to pigment would become 7:3. The resulting kneaded product was cooled and then pulverized by a feather mill, by which a pigment masterbatch was obtained.

Ninety three parts by weight of polyester resin A93, 10 parts by weight of the pigment masterbatch, 2 parts by weight of salicylic acid zinc complex (E-84, made by Orient Kagaku Kogyo K.K.) and 2 parts by weight of oxidized polypropylene wax (100TS, made by Sanyo Kasei K.K., with softening point 140° C., acid value 3.5 KOH mg/g) were mixed sufficiently with a Henschel mixer. The resulting mixture was melted and kneaded by using a twin screw extrusion kneader (PCM-30, made by Ikegai Tekko K.K.) with its discharge part removed. The resulting kneaded product was drawn into a 2 mm thickness by a cooling press and cooled by a cooling belt, and afterwards coarsely pulverized by a feather mill. The coarsely pulverized particles were pulverized to a mean particle size of 10 to 12 μm with a mechanical mill (KTM, made by Kawasaki Jukogyo K.K.), further finely pulverized to a mean particle size of 8 μm with a jet mill (IDS, made by Nippon Pneumatic Kogyo K.K.), and further micro-powder classified with a rotor classifier (Teeplex classifier type, 100ATP, made by Hosokawa Micron K.K.), by which yellow toner particles with a volume-average particle size of 8.0 μm. To 100 parts by weight of these toner particles, were added 0.5 part by weight of hydrophobic silica (TS-500, made by Cabosil Co. Ltd.) and 1.0 part by weight of hydrophobic titanium dioxide (STT30A, made by Chitan Kogyo K.K.), and were mixed by a Henschel mixer, by which yellow toner A was obtained.

(Examples 2–5)

In the same way as in Example 1 except that the polyester resin A was changed to polyester resins B–E, yellow toners B–E were obtained.

(Example 6)

In the same way as in Example 1 except that the oxidized polypropylene wax was changed to 1 part by weight of an oxidized polyethylene wax (405 MP, made by Mitsui Sekiyu Kagaku K.K., with softening point 128° C., acid value 1.0 KOH mg/g), a yellow toner F was obtained.

(Example 7)

In the same way as in Example 1 except that the oxidized polypropylene wax was changed to 1 part by weight of an oxidized polyethylene wax (2203A, made by Mitsui Sekiyu Kagaku K.K., with softening point 111° C., acid value 30 KOH mg/g), a yellow toner G was obtained.

(Example 8)

In the same way as in Example 1 except that the oxidized polypropylene wax was changed to 2 parts by weight of a carnauba wax (Carnauba No. 1 Flake, made by Toyo Petroito K.K., with melting point 84.5° C., acid value 2.8 KOH mg/g), a yellow toner H was obtained.

(Comparative Example 1)

In the same way as in Example 1 except that the oxidized polypropylene wax was changed to 2 parts by weight of a non-oxidized polypropylene wax (Viscol 550P, made by Sanyo Kasei Kogyo K.K., with softening point 150° C., acid value 0 KOH mg/g), a yellow toner I was obtained.

(Comparative Example 2)

In the same way as in Example 1 except that the oxidized polypropylene wax was changed to 2 parts by weight of an oxidized polyethylene wax (1105A, made by Mitsui Sekiyu Kagaku K.K., with softening point 108° C., acid value 60 KOH mg/g), a yellow toner J was obtained.

(Comparative Example 3)

In the same way as in Example 1 except that the C. I. pigment yellow 180 was changed to C. I. pigment yellow 62, a yellow toner K was obtained.

(Comparative Example 4)

In the same way as in Example 1 except that the oxidized polypropylene wax was not added, a yellow toner L was obtained.

Each of the above toners was dissolved in chloroform and centrifugally separated. Wax particles that became suspended were collected, and a photograph image of the wax particles was inputted to an image analyzer (Loozex 5000, made by Nippon Regulator K.K.), in which condition the particle size distribution was measured, the results being shown in Table 2. It is noted that, for incompletely spherical wax particles, the particle size of each wax particle was determined by measuring the maximum diameter of the wax particle.

TABLE 2

| | particle size distribution of wax particles (number %) | | | | | Max. size of wax particles |
|---|---|---|---|---|---|---|
| | <1 μm | >1 μm, <2 μm | >2, <3 μm | >3, <5 μm | >5 μm | present in distribution |
| Ex. 1 | 70.1 | 26.3 | 3.5 | 0.1 | 0 | 3.1 |
| Ex. 2 | 71.3 | 27.1 | 1.5 | 0.1 | 0 | 3.2 |
| Ex. 3 | 74.1 | 25.2 | 0.7 | 0 | 0 | 2.8 |
| Ex. 4 | 68.8 | 23.7 | 7.2 | 0.3 | 0 | 3.2 |
| Ex. 5 | 78.1 | 18.7 | 3.2 | 0 | 0 | 2.6 |
| Ex. 6 | 65.3 | 24.3 | 9.6 | 0.8 | 0 | 3.4 |
| Ex. 7 | 78.3 | 19.3 | 2.4 | 0 | 0 | 2.7 |
| Ex. 8 | 65.2 | 24.1 | 9.7 | 1.0 | 0 | 3.8 |
| Comp. Ex. 1 | 45.1 | 23.6 | 18.7 | 9.1 | 3.5 | 6.1 |
| Comp. Ex. 2 | 77.3 | 20.6 | 2.1 | 0 | 0 | 2.6 |
| Comp. Ex. 3 | 68.7 | 25.1 | 5.8 | 0.4 | 0 | 3.7 |
| Comp. Ex. 4 | — | 13 | — | — | — | — |

Each of the above toners was subjected to the following evaluations, the results being shown in Table 3:

OHP light-transmittance and color reproducibility of images with different dot area ratios.

With a full-color printer as described below, images with dot area ratio 100%, 50% and 20% were depicted through a 150-line screen onto an OHP sheet under a normal-temperature, normal-humidity environment (25° C., 60% RH), and projected by an overhead projector, in which case color developing property of yellow was visually evaluated. The evaluation was ranked ○ for clear coloring, Δ for less coloring and x for no coloring.

The full-color printer used in this evaluation was of a construction as shown in FIG. 1, comprising a photosensitive drum 10 (hereinafter, referred to as photosensitive member 10) driven to rotate in the direction shown by arrow in the figure, a laser scanning optical system 20, a full-color developing unit 30, an endless intermediate transfer belt 40 driven to rotate in the direction shown by arrow in the figure, and a sheet feed unit 60. Around the photosensitive member 10, are further provided a charging brush 11 for charging the surface of the photosensitive member 10 to a specified voltage level and a cleaner 12 for removing toner that has remained on the photosensitive member 10.

The laser scanning optical system 20 is a known system internally equipped with a laser diode, a polygon mirror and an fθ optical device. To its control unit, print data for each of cyan (C), magenta (M), yellow (Y) and black (BK) are transferred from the host computer. The laser scanning optical system 20 puts out print data for individual colors as laser beams in succession, making scans on the photosensitive member 10 by exposure. As a result, electrostatic latent images for the individual colors are formed in succession on the photosensitive member 10.

The full-color developing unit 30 comprises integrated four developing devices 31C, 31M, 31Y, 31BK dedicated for the individual colors and containing one-component developers composed of C, M, Y and BK non-magnetic toners, respectively. The full-color developing unit 30 is rotatable clockwise on a fulcrum of a spindle 33. Each developing device is equipped with a developing sleeve 32 and toner regulating blades 34*a,* 34*b.* Toner conveyed by the developing sleeve 32 rotating is electrically charged by passing the press contact part (regulating part) between the blades 34*a,* 34*b* and the developing sleeve 32.

The intermediate transfer belt 40 is driven to rotate in a direction shown by arrow in the figure in synchronization with the photosensitive member 10. The intermediate transfer belt 40 is pressed by a rotatable primary transfer roller 41 so as to be in contact with the photosensitive member 10. Also, the intermediate transfer belt 40 is in contact with a rotatable secondary transfer roller 43 at a portion where it is supported by a support roller 42.

In a space formed between the full-color developing unit 30 and the intermediate transfer belt 40, is further placed a cleaner 50. The cleaner 50 has a blade for removing remaining toner on the intermediate transfer belt 40. This blade and the secondary transfer roller 43 are contactable with and separable from the intermediate transfer belt 40.

The sheet feed unit 60 comprises a sheet feed tray 61 openable on the front side of an image forming apparatus body 1, a sheet feed roller 62 and a timing roller 63. Recording sheets S are stacked on the sheet feed tray 61, and fed rightward as viewed in the figure one by one by the sheet feed roller 62 rotating. The recording sheets S are sent out for the secondary section by the timing roller 63 synchronously with an image formed on the intermediate transfer belt 40. A horizontal conveyance path for recording sheets is formed by an air suction belt 66 and others so as to include the sheet feeder section, while a vertical conveyance path 80 equipped with a conveyance roller is provided so as to range from a fixing unit 70. The recording sheets S are discharged from the vertical conveyance path 80 onto the top surface of the image forming apparatus body 1.

Printing operation of the full-color printer is now explained. With a printing operation started, the photosensitive member 10 and the intermediate transfer belt 40 are driven to rotate at the same peripheral speed, where the photosensitive member 10 is electrically charged to a specified voltage level.

Subsequently, exposure of a cyan image is performed by the laser scanning optical system 20, so that an electrostatic latent image of the cyan image is formed on the photosensitive member 10. This electrostatic latent image is immediately developed by the developing device 31C, and besides the toner image is transferred onto the intermediate transfer belt 40 in the primary developing section. Upon completion of the primary transfer, the developing section D is switched to the developing device 31M, in which condition a magenta image is subjected to exposure, development and primary transfer processes. Further, with a switch to the developing device 31Y, a yellow image is subjected to exposure, development and primary transfer processes. Still further, with a switch to the developing device 31BK, a black image is subjected to exposure, development and primary transfer processes. Over these processes, toner images are superimposed one by one on the intermediate transfer belt 40 at each primary transfer process.

With the final primary transfer completed, the recording sheet S is sent into the secondary transfer section, where a full-color toner image formed on the intermediate transfer belt 40 is transferred onto the recording sheet S. With this secondary transfer completed, the recording sheet S is conveyed to the belt type contact-and-heating fixing unit 70, where the full-color toner image is fixed onto the recording sheet S. The recording sheet S is then discharged onto the top surface of the image forming apparatus body 1.

In addition, the above image formation was carried out on the bases of a −550 V photosensitive member surface potential, a −200 V developing bias voltage, a 900 V primary transfer bias voltage and a 500 V secondary transfer bias voltage, and under such a set condition that the toner adhesion in the solid image portions on the recording sheet would be 0.7 mg/cm$^2$, and under the condition of a 160° C. fixing temperature.

(Offset Resistance)

An electrophotographic printer (SP-1000, made by Minolta K.K.) equipped with a non-magnetic one-component developing unit was modified so as to allow the set temperature of the fixing roller to be adjusted. Then, with the set temperature of the fixing roller varied, image development was carried out, where the temperature at which the offset phenomenon would occur was determined. Toners showing offset occurrence temperatures of 180° C. or higher were evaluated as ◎, toners of equal to or over 160° C. and less than 180° C. were evaluated as ○, toners of equal to or over 140° C. and less than 160° C. were evaluated as Δ and toners of less than 140° C. were evaluated as x.

(Adhesion)

With the above SP-1000 photosensitive member removed, each of the toners was placed in the developing unit, and the developing sleeve was continuously rotated for 20 hours. Toners with which toner adhesion occurred to the developing sleeve or the toner regulating blade so that white lines were formed on the developing sleeve (a phenomenon that an absence of toner layer is formed linearly on the sleeve due to the toner adhesion in the regulating section), resulting in noise on the image, were evaluated as x, toners of no practical problem with slight white lines formed but without occurrence of noise on the image were evaluated as Δ, and toners free from white lines were evaluated as ○.

(Filming)

After a durability-test printing of 6000 copies by the SP-1000, the photosensitive member was evaluated visually at its top. Toners from which filming was never observed were evaluated as ○, toners from which filming was slightly observed but did not appear as noise on the image were evaluated as Δ, and toners from which filming was observed and appeared as noise on the image were evaluated as x. It is noted that Comparative Example 2 (toner J) and Comparative Example 4 (toner L) caused considerable occurrence of toner adhesion to the blade or the sleeve so that the durability-test printing was discontinued in those comparative examples.

TABLE 3

| | OHP transmitlancy and color reproducibility | | | Offset withstanding | | |
|---|---|---|---|---|---|---|
| | 100% | 50% | 20% | property | Filming | Adhesion |
| Ex. 1 | ○ | ○ | ○ | ◎ | ○ | ○ |
| Ex. 2 | ○ | ○ | ○ | ◎ | ○ | ○ |
| Ex. 3 | ○ | ○ | ○ | ◎ | ○ | ○ |
| Ex. 4 | ○ | ○ | ○ | ◎ | ○ | ○ |
| Ex. 5 | ○ | ○ | ○ | ◎ | ○ | ○ |
| Ex. 6 | ○ | ○ | ○ | ○ | ○ | ○ |
| Ex. 7 | ○ | ○ | ○ | ○ | ○ | ○ |
| Ex. 8 | ○ | ○ | ○ | ○ | ○ | ○ |
| Comp. Ex. 1 | x | x | x | 0 | x | ○ |
| Comp. Ex. 2 | ○ | ○ | ○ | x | — | x |
| Comp. Ex. 3 | ○ | Δ | x | ◎ | ○ | ○ |
| Comp. Ex. 4 | ○ | ○ | ○ | x | — | x |

Preparation of Cyan Toner, Magenta Toner, and Black Toner

A cyan toner was obtained in the same way as in Example 1, except that C. I. pigment yellow 180 was changed to C. I. pigment blue 15-3.

A magenta toner was obtained in the same way as in Example 1, except that C. I. pigment yellow 180 was changed to C. I. pigment red 184.

A black toner was obtained in the same way as in Example 1, except that C. I. pigment yellow 180 was changed to carbon black (Mogul L; made by Cabot), 5 parts by weight.

Also, the yellow toner A obtained in Example 1, the cyan toner, magenta toner and black toner obtained in the above preparation examples were subjected to a durability test of 3000 copies with a full-color image having a B/W ratio of 6% by using the full-color printer. As a result of evaluating images after the durability test printing, there was neither occurrence of offset nor occurrence of noise or filming due to toner adhesion.

(Preparation Example of Carrier)

A hundred parts by weight of bisphenol A type polyester resin with acid value 2 KOH mg/g and glass transition point 60° C., 400 parts by weight of magnetic powder (EPT-1000, made by Toda Kogyo K.K.), 5 parts by weight of carbon black (Ketchen Black EC, made by Lion Yushi K.K.) and 2 parts by weight of silica (H2000, made by Hoechst K.K.) were well mixed with a Henschel mixer, and then melted and kneaded with a twin screw extrusion kneader. The resulting kneaded product was cooled, then coarsely pulverized with a feather mill and further finely pulverized with a jet mill, and thereafter subjected to a micro-powder classification with an air classifier. After this, the product was heated at 300° C. with a surfusing system (SFS-1, made by Nippon Pneumatic K.K.), by which a carrier having a volume-average particle size of 35 $\mu$m was obtained.

Figure 2:
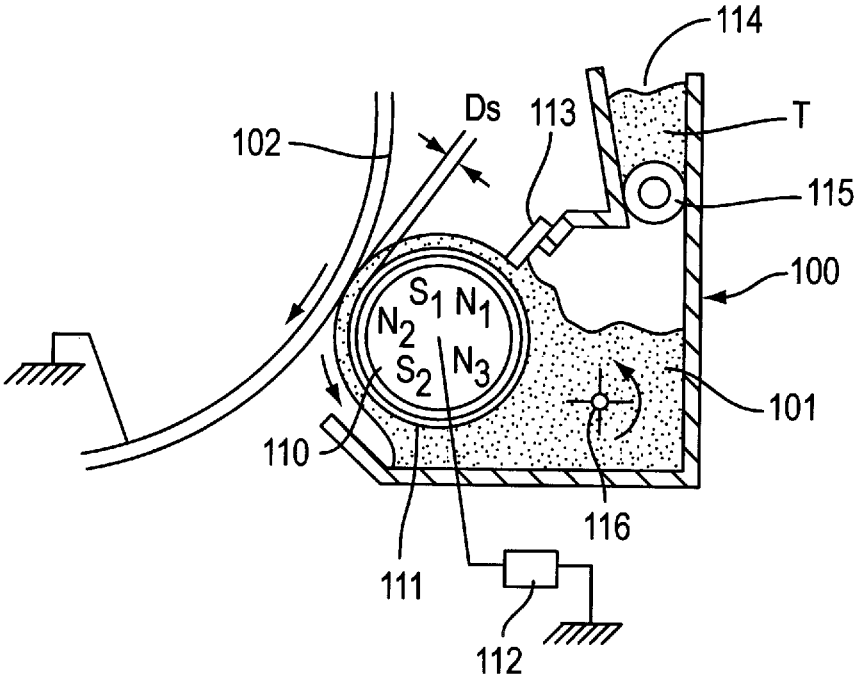
FIG. 2 is a schematic explanatory view of a two-component developing unit.

Next, for a case where the yellow developer of the present invention is used as a two-component developer, an experiment was carried out with the developing unit of FIG. 2. A yellow developer in which the yellow developer B of Example 2 and the carrier obtained in the foregoing preparation example were mixed so that the toner concentration would be 7 weight % was used as the developer for the experiment.

With a developing unit 100 of FIG. 2, inversion development was carried out under the conditions of a 4.5 mg/cm$^2$ conveyance amount of the developer conveyed to the development area, a 0.35 mm Ds, a 120 mm/sec. peripheral speed of a photosensitive member 102, a 300 mm/sec. peripheral speed of a developing sleeve 111 and a −450 V voltage of the photosensitive member surface, and besides under a developing bias obtained by superimposing a −350 V DC voltage on an AC voltage having a 1.4 KV peak-to-peak voltage, a rectangular waveform of a 3 KHz frequency and a 1:1 duty ratio (development:recovery) with developing bias power supply 112. With the use of the yellow developer, 10,000-copy image formation was carried out and the resulting images in initial stage and after the durability test printing were evaluated in terms of density variations and fogging. As a result, images free from density variations and fogging were able to be obtained in all cases.

In addition, the constitution of the developing unit of FIG. 2 used for the above evaluation is briefly explained. In the developing unit 100, a developer 101 including toner T and carrier is contained inside, and the cylindrical developing sleeve 111 in which a magnet roller 110 having a plurality of magnetic poles are fixedly disposed inside is rotatably disposed. The developing sleeve 111 is placed in the developing area so as to be opposed to the negatively chargeable organic photosensitive member 102 with an appropriate distance Ds.

The developing sleeve 111 is also connected to the developing bias power supply 112. A developing bias voltage obtained by superimposing a DC voltage on an AC voltage from the developing bias power supply 112 is applied to the developing sleeve 111, so that an oscillatory electric field is effectuated on the developing area.

A magnetic blade 113 is provided at a place opposite to a magnetic pole N1 of the magnet roller 110 on the upstream side of the developing area in the developer conveyance direction, with a specified spacing to the developing sleeve 111. Thus, the amount of developer on the developing sleeve 111 is restricted by the magnetic blade 113.

In the developing unit 100 also, a toner storage 114 for storing the toner T is provided in an upper portion. When the toner density of the developer in the developing unit 100 has lowered as a result of performing developing process with the toner contained in the developer from the developing sleeve 111, the toner T is resupplied by rotating a toner resupply roller 115 provided at a lower portion of the toner storage 114. Resupplied toner is mixed and stirred with the developer by a mixing and stirring member 116, and fed to the developing sleeve 111.

With this arrangement, in the developing unit 100, the amount of developer on the developing sleeve 111 is restricted by the magnetic blade 113, the developer is formed into a thin layer on the developing sleeve 111 and conveyed to the developing area, a developing bias voltage is applied from the developing bias power supply 112 to effectuate an oscillatory electric field on the developing area, and the toner contained in the developer conveyed by the developing sleeve 111 is fed to the electrostatic latent image part of the photosensitive member 102 from the developing sleeve 111, where the development is carried out.

According to the present invention, the yellow developer for use in full-color image forming apparatuses capable of reproducing multicolor images is enabled to offer excellent OHP color reproducibility and offset withstand property at the same time.

Also according to the present invention, both the OHP light transmitting and color reproducing properties for images having smaller dot sizes and low dot area ratios can be improved.

Also according to the present invention, the issue of toner adhesion to the developing sleeve or the toner regulating member can be solved in applications to the non-magnetic one-component development system.

What is claimed is:

1. A yellow developer comprising:

a non-magnetic toner particle containing colorant, binder resin and wax, the colorant being a compound classified into C. I. pigment yellow 180, the binder resin having an acid value of 1 to 30 KOH mg/g, and the wax having an acid value of 0.5 to 30 KOH mg/g.

2. The yellow developer according to claim 1, wherein the wax has a softening point of 110° to 160° C. and content of the wax is 0.5 to 5 parts by weight on a basis of 100 parts by weight of the binder resin.

3. The yellow developer according to claim 1, wherein the wax has an acid value of 1 to 20 KOH mg/g and the binder resin has an acid value of 1 to 25 KoHmg/g.

4. The yellow developer according to claim 1, wherein the binder resin has a glass transition point of 55° to 75° C., a softening point of 95° to 120° C., a number-average molecular weight of 2500 to 6000 and a ratio of weight-average molecular weight/number-average molecular weight of 2 to 8.

5. The yellow developer according to claim 4, wherein the binder resin is a polyester resin obtained from a bisphenol A alkylene oxide adduct and a phthalic acid or derivative thereof.

6. The yellow developer according to claim 1, wherein the colorant is masterbatch-treated.

7. The yellow developer according to claim 1, wherein the yellow developer contains 0.2 to 3 weight % of inorganic fine particles with respect to the toner.

8. A non-magnetic yellow toner comprising:

a binder resin having an acid value of 1 to 30 KOH mg/g;

a colorant comprising a compound classified into C. I. pigment yellow 180; and a wax having an acid value of 0.5 to 30 KOH mg/g dispersed in the binder resin as wax particles, wherein the wax particles contained in the toner have a particle size distribution that wax particles with particle size equal to or more than 3 $\mu$m occupy 3 number % or less, wax particles with particle size equal to or more than 2 $\mu$m and less than 3 $\mu$m occupy 12 number % or less, wax particles with particle size equal to or more than 1 $\mu$m and less than 2 $\mu$m occupy 5 to 30 number %, and wax particles with particle size less than 1 $\mu$m occupy 55 to 95 number %.

9. The non-magnetic yellow toner according to claim 8, wherein the yellow toner has a particle size distribution that wax particles with particle size equal to or more than 2 $\mu$m and less than 3 $\mu$m occupy 10 number % or less, wax particles with particle size equal to or more than 1 $\mu$m and less than 2 $\mu$m occupy 5 to 27 number %, and wax particles with particle size less than 1 $\mu$m occupy 60 to 95 number %.

10. The non-magnetic yellow toner according to claim 8, wherein the wax has a softening point of 110° to 160° C. and an acid value of 1 to 20 KOH mg/g, and the binder resin has an acid value of 1 to 25 KOH mg/g.

11. The non-magnetic yellow toner according to claim 8, wherein the binder resin has a glass transition point of 55° to 75° C., a softening point of 95° to 120° C., a number-average molecular weight of 2500 to 6000, and a ratio of weight-average molecular weight/number-average molecular weight of 2 to 8.

12. A one-component development process comprising:

a step of feeding a one-component developer including a non-magnetic yellow toner particle which contains a binder resin having an acid value of 1 to 30 KOH mg/g, a colorant being a compound classified into C. I. pigment yellow 180 and a wax having an acid value of 0.5 to 30 KOH mg/g, to a developer supporting member provided so that its surface is movable;

a step of, with an arrangement that a developer regulating member is disposed in contact with the developer supporting member, conveying the developer by the developer supporting member so that the developer is brought into contact with the developer regulating member, thereby forming a thin layer of electrically charged developer on the developer supporting member;

a step of conveying the electrically charged developer to an area where the developer supporting member and an electrostatic latent image supporting member are opposed to each other; and a step of developing an electrostatic latent image retained on the electrostatic latent image supporting member with the electrically charged developer.

13. The one-component development process according to claim 12, wherein the wax has a softening point of 110° to 160° C. and an acid value of 1 to 20 KOH mg/g, and the binder resin has an acid value of 1 to 25 KOH mg/g.

14. The one-component development process according to claim 12, wherein the binder resin has a glass transition point of 55° to 75° C., a softening point of 95° to 120° C., a number-average molecular weight of 2500 to 6000 and a ratio of weight-average molecular weight/number-average molecular weight of 2 to 8.

15. The one-component development process according to claim 12, wherein the wax is dispersed in the binder resin as wax particles, and the wax particles have a particle size distribution that wax particles with particle size equal to or more than 3 μm occupy 3 number % or less, wax particles with particle size equal to or more than 2 μm and less than 3 μm occupy 12 number % or less, wax particles with particle size equal to or more than 1 μm and less than 2 μm occupy 5 to 30 number %, and wax particles with particle size less than 1 μm occupy 55 to 95 number %.

16. A two-component development process comprising:

a step of feeding a two-component developer including a non-magnetic yellow toner particle and a magnetic carrier particle, the non-magnetic yellow toner particle containing a binder resin having an acid value of 1 to 30 KOH mg/g, a colorant being a compound classified into C. I. pigment yellow 180 and a wax having an acid value of 0.5 to 30 KOH mg/g, to a developer transporting member having an internally fixedly disposed magnet member and provided so that its surface is movable;

a step of regulating amount of the developer on the developer transporting member to 0.7 to 10 mg/cm$^2$;

a step of conveying the developer by the developer transporting member to an area where the developer transporting member and an electrostatic latent image supporting member are opposed to each other; and a step of developing an electrostatic latent image retained on the electrostatic latent image supporting member with the developer under an oscillatory electric field.

17. The two-component development process according to claim 16, wherein the carrier particle has a volume-average particle size of 20 to 50 μm, and the toner particle has a volume-average particle size of 4 to 10 μm.

18. The two-component development process according to claim 16, wherein the wax has a softening point of 110° to 160° C. and an acid value of 1 to 20 KoH mg/g, and the binder resin has an acid value of 1 to 25 KOH mg/g.

19. The two-component development process according to claim 16, wherein the binder resin has a glass transition point of 55° to 75° C., a softening point of 95° to 120° C., a number-average molecular weight of 2500 to 6000 and a ratio of weight-average molecular weight/number-average molecular weight of 2 to 8.

20. The two-component development process according to claim 16, wherein the wax is dispersed in the binder resin as wax particles, and the wax particles have a particle size distribution that wax particles with particle size equal to or more than 3 μm occupy 3 number % or less, wax particles with particle size equal to or more than 2 μm and less than 3 μm occupy 12 number % or less, wax particles with particle size equal to or more than 1 μm and less than 2 μm occupy 5 to 30 number %, and wax particles with particle size less than 1 μm occupy 55 to 95 number %.

* * * * *

UNITED STATES PATENT AND TRADEMARK OFFICE

CERTIFICATE OF CORRECTION

PATENT NO. : 5,843,605

DATED : December 1, 1998

INVENTOR(S) : Masahiro ANNO et al.

It is certified that error appears in the above-identified patent and that said Letters Patent is hereby corrected as shown below:

Col. 18, line 29, change "KoH" to --KOH--.

Signed and Sealed this

Eighteenth Day of May, 1999

*Attest:*

*Attesting Officer*

Q. TODD DICKINSON

*Acting Commissioner of Patents and Trademarks*